US011529663B1

(12) United States Patent
Gambino

(10) Patent No.: US 11,529,663 B1
(45) Date of Patent: Dec. 20, 2022

(54) TUBE BENDING MACHINES WITH ALIGNMENT SYSTEMS

(71) Applicant: Joseph Gambino, Sandy, OR (US)

(72) Inventor: Joseph Gambino, Sandy, OR (US)

(73) Assignee: Rogue Fabrication, LLC, Sandy, OR (US)

( * ) Notice: Subject to any disclaimer, the term of this patent is extended or adjusted under 35 U.S.C. 154(b) by 0 days.

(21) Appl. No.: 17/389,220

(22) Filed: Jul. 29, 2021

(51) Int. Cl.
*B21D 7/08* (2006.01)
*B21D 43/00* (2006.01)

(52) U.S. Cl.
CPC ..... *B21D 7/085* (2013.01); *B21D 43/003* (2013.01)

(58) Field of Classification Search
CPC ..... B21D 7/02; B21D 7/022; B21D 7/024; B21D 7/04; B21D 7/08; B21D 7/085
See application file for complete search history.

(56) References Cited

U.S. PATENT DOCUMENTS 7,444,849 B1 * 11/2008 Hsueh ..... B21D 7/024 72/149
8,991,229 B1 * 3/2015 Cheng ..... B21D 7/024 72/149
2020/0070227 A1 * 3/2020 Gemignani ..... B21D 7/024

FOREIGN PATENT DOCUMENTS

GB 146576 A * 7/1920

* cited by examiner

*Primary Examiner* — Teresa M Ekiert
(74) *Attorney, Agent, or Firm* — Mohr IP Law Solutions, PC

(57) ABSTRACT

Tube bending machines configured to bend a tube at a target bend location. The tube bending machines include a frame, a bending die assembly, and an alignment stem. The bending die assembly is supported on the frame and configured to bend the tube. The bending die assembly includes a bending die, a wheel frame, and a clamp. The wheel frame is coaxially mounted to the bending die. The clamp is configured to secure the tube to the wheel frame. The bending die, the wheel frame, and the clamp cooperate to define an actual bend location where the tube will be bent by the bending die assembly. The alignment system is operatively supported on the frame and configured to align the target bend location with the actual bend location.

15 Claims, 8 Drawing Sheets

TUBE BENDING MACHINES WITH ALIGNMENT SYSTEMS

BACKGROUND

The present disclosure relates generally to tube bending machines. In particular, tube bending machines with alignment systems are described.

Tubes, pipes, and solid bars are common types of workpieces that are used for many different purposes. Tubes and pipes may be used to transfer fluids, either liquid or gas, from one location to another. Solid bars, tubes, a is types (hereinafter simply tubes) can be used structurally as well, such as tin conduit, roll cage, and handrail applications. Tubes come in a variety of shapes, Including round, square, rectangular, aerodynamic shapes, and ovoid shapes among others.

Bending tubes is also useful for many different applications, Bending a tube is often necessary to process the tube into a specified shape for a given end product, such as a coil, a curved exhaust pipe, or a U-shaped conduit. Tube bending devices are generally used to bend tubes.

Known tube bending machines are not entirely satisfactory. For example, existing tube bending machines are difficult to align properly. In particular, it is difficult to align a tube intended to be bent at a specific location with the actual location where the tube bending machine will bend it. As a result, tubes are often bent inaccurately at unintended locations with conventional tube bending machines. Inaccurate bends can reduce the quality of the end product and/or render the tube unusable waste.

Thus, there exists a need for tube bending machines that improve upon and advance the design of known tube bending machines. Examples of new and useful tube bending machines relevant to the needs existing in the field are discussed below.

SUMMARY

The present disclosure is directed to tube bending machines configured to bend a tube at a target bend location. The tube bending machines include a frame, a bending die assembly, and an alignment system. The bending die assembly is supported on the frame and configured to bend the tube. The bending die assembly includes a bending die, a wheel frame, and a clamp. The wheel frame is coaxially mounted to the bending die. The clamp is configured to secure the tube to the wheel frame. The bending die, the wheel frame, and the clamp cooperate to define an actual bend location where the tube will be bent by the bending die assembly. The alignment system is operatively supported on the frame and configured to align the target bend location with the actual bend location.

DETAILED DESCRIPTION

Figure 1:
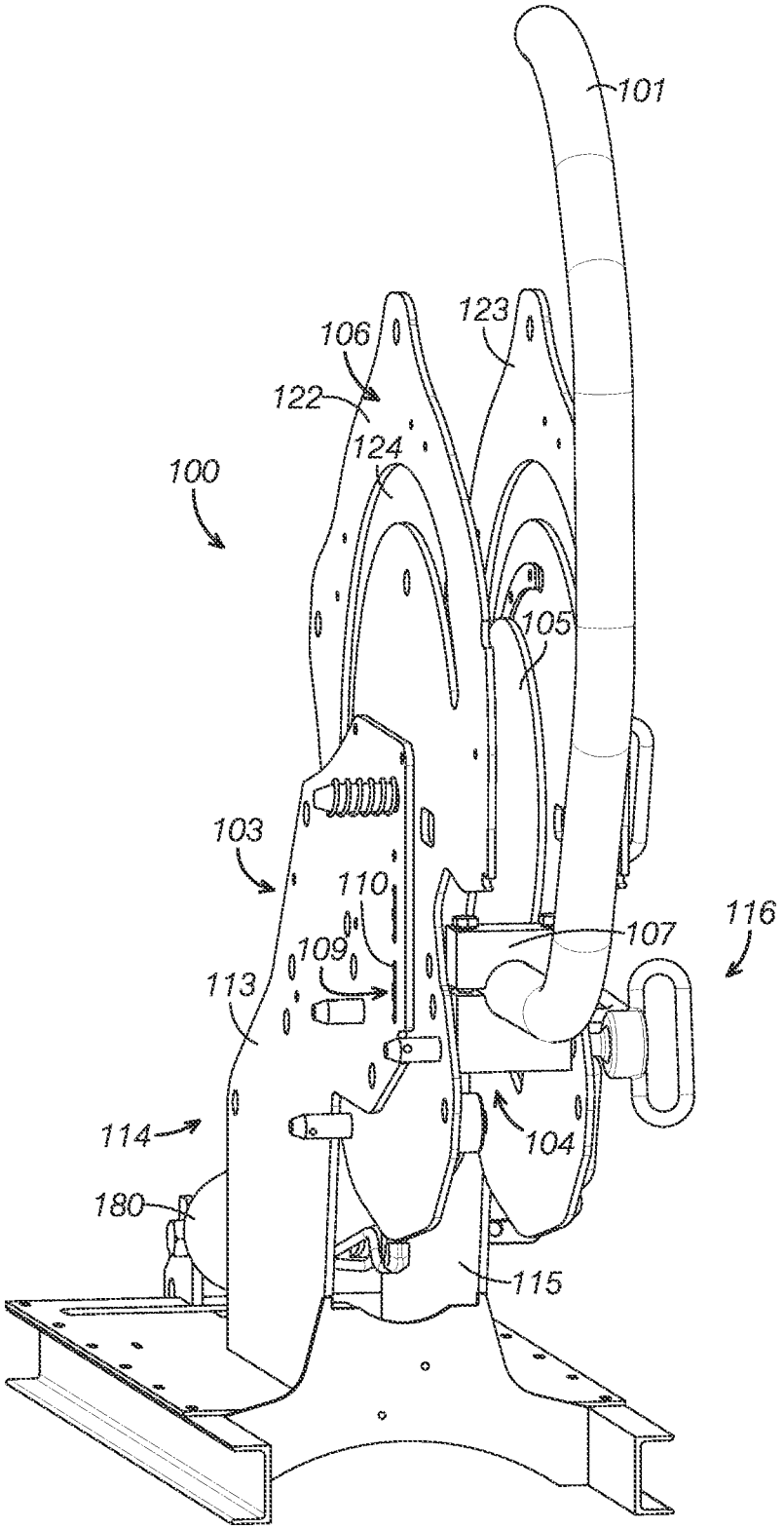
FIG. 1 is a perspective view of a tube bending machine

The disclosed tube bending machines will become better understood through review of the following detailed description in conjunction with the figures. The detailed description and figures provide merely examples of the various inventions described herein. Those skilled ii the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various tube bending machines are provided. Related features in the examples may be identical, similar, or dissimilar different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Tube Bending Machines with Alignment Systems

With reference to the figures, tube bending machines with alignment systems will now be described. The tube bending machines discussed herein function to bend tubes and to assist a user to properly align a tube within the tube bending machine for accurate bends.

The reader will appreciate from the figures and description below that the presently disclosed tube bending machines address many of the shortcomings of conventional tube bending machines. For example, the novel tube bending machines described below are configured to accurately align a tube within the tube bending machine to facilitate bending the tube accurately. In particular, the tube bending machines discussed herein make it easy and convenient to align a tube intended to be bent at a specific location with the actual location where the tube bending machine will bend it. As a result, tubes are bent more accurately at intended locations than is possible with conventional tube bending machines. Tubes bent with the novel tube bending machines described in this document lead to higher quality end products and reduce processing waste.

Contextual Details

Ancillary features relevant to the tube bending machines described herein will first be described to provide context and to aid the discussion of the tube bending machines.

Tube

Figure 3:
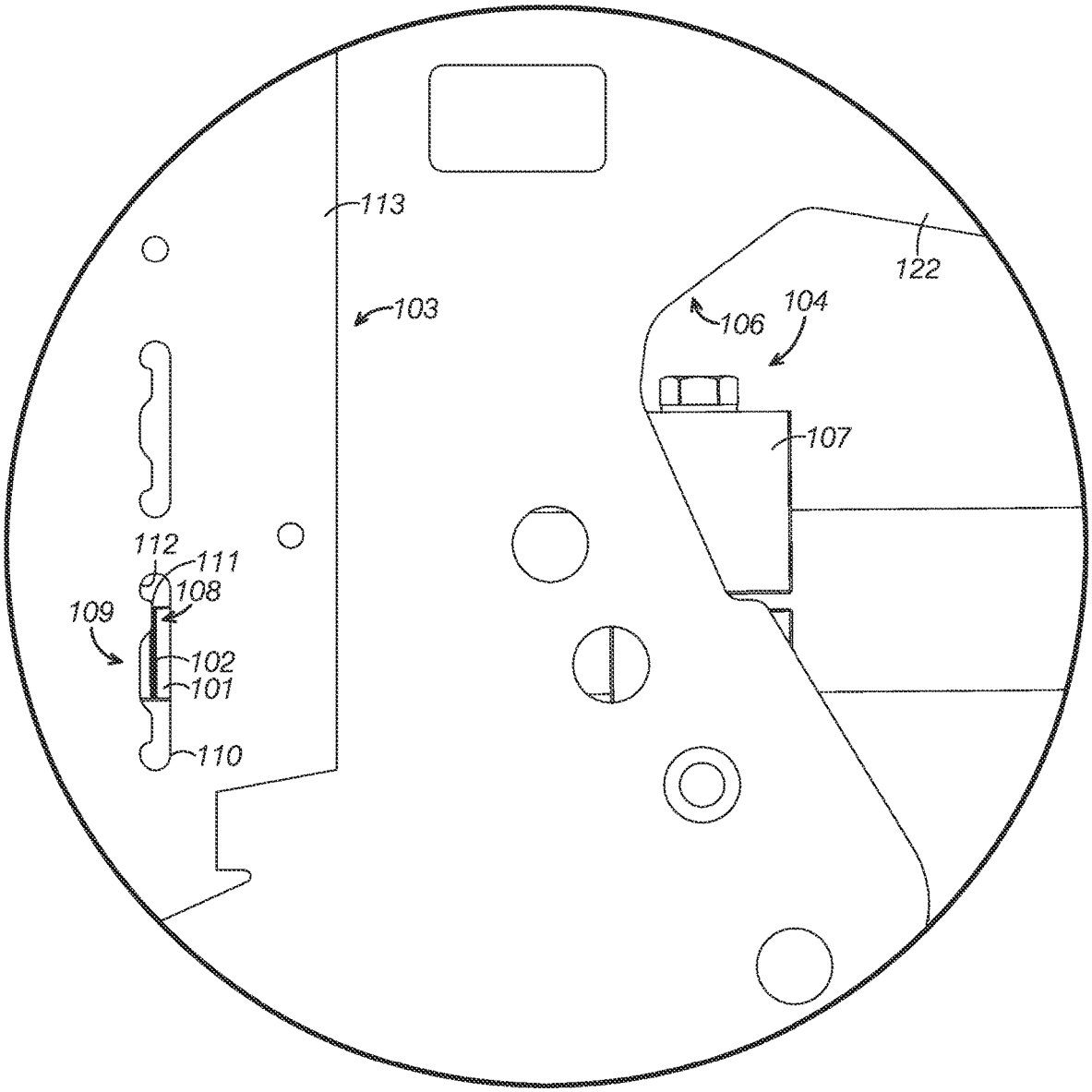
FIG. 3 is a close up view of a alignment system of the tube bending machine shown FIG. 1.
Figure 4:
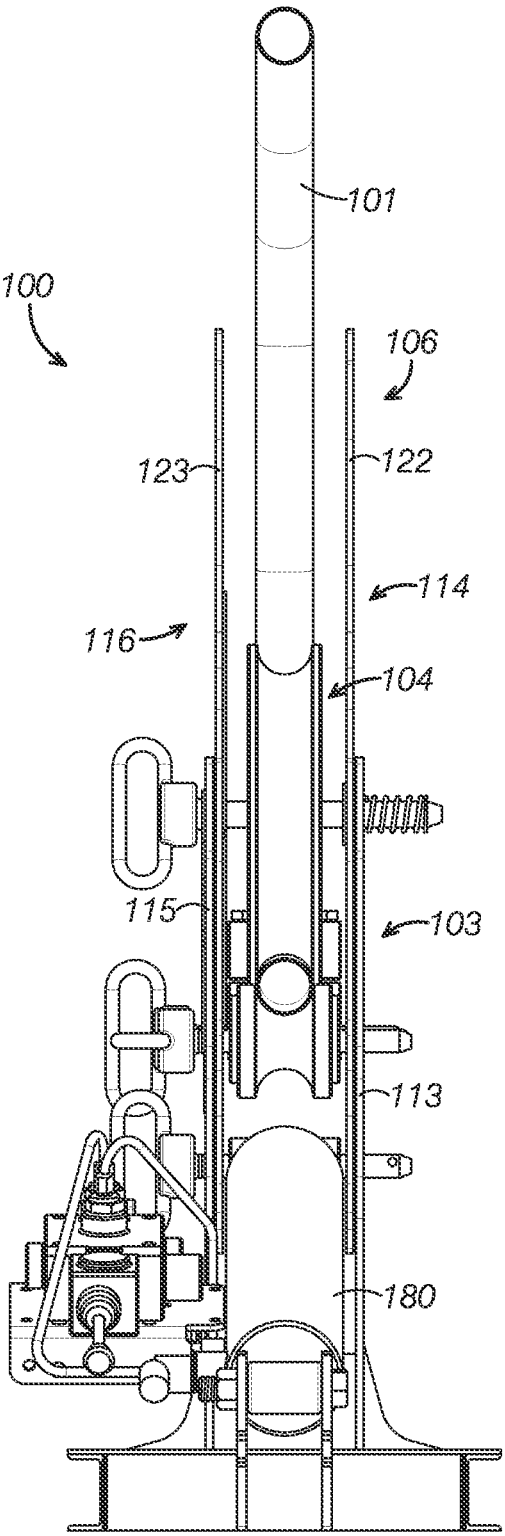
FIG. 4 is a rear end view of the tube bending machine shown in FIG. 1.
Figure 5:
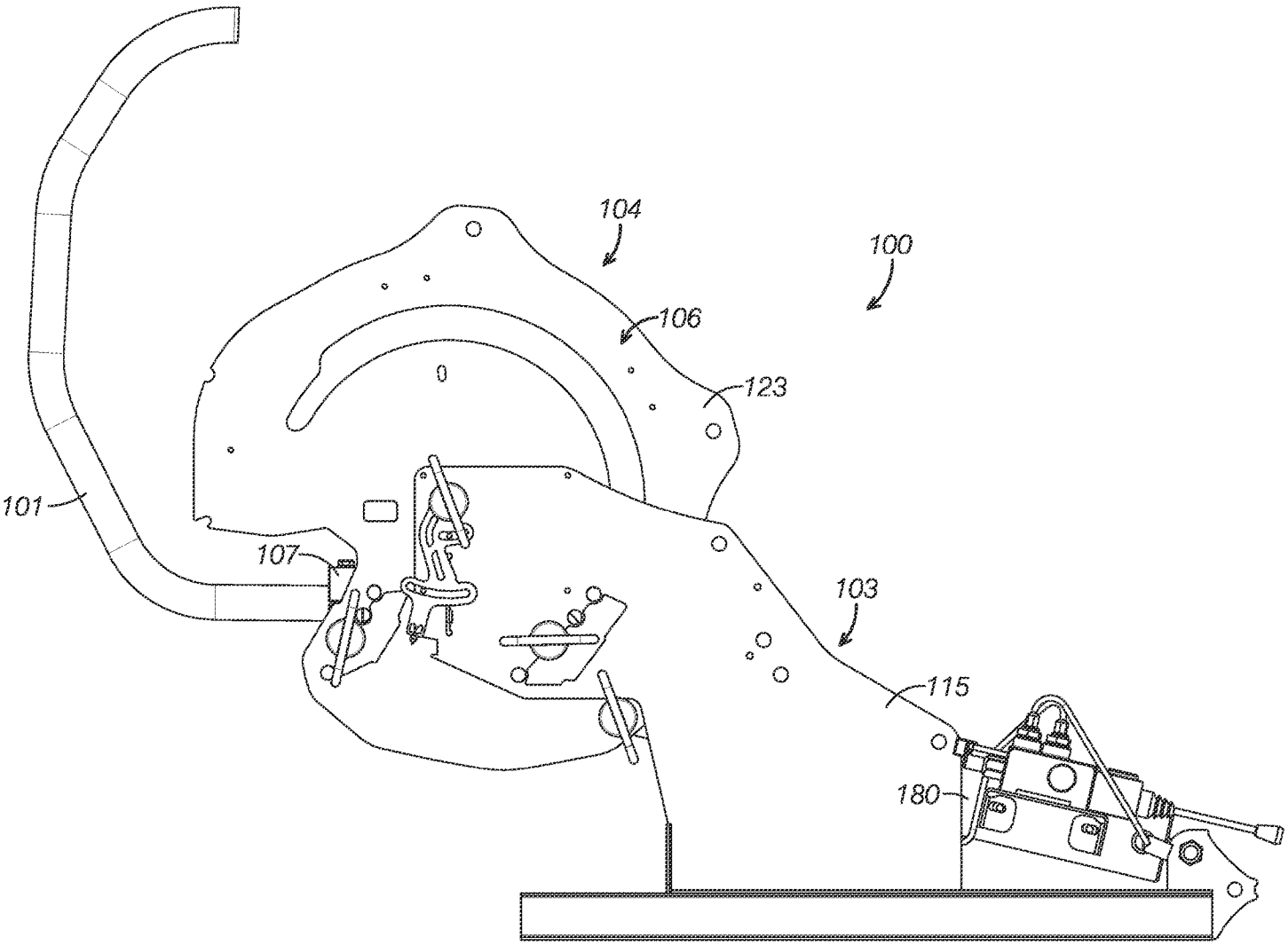
FIG. 5 is a left side elevation view of the tube bending machine shown in FIG. 1.
Figure 6:
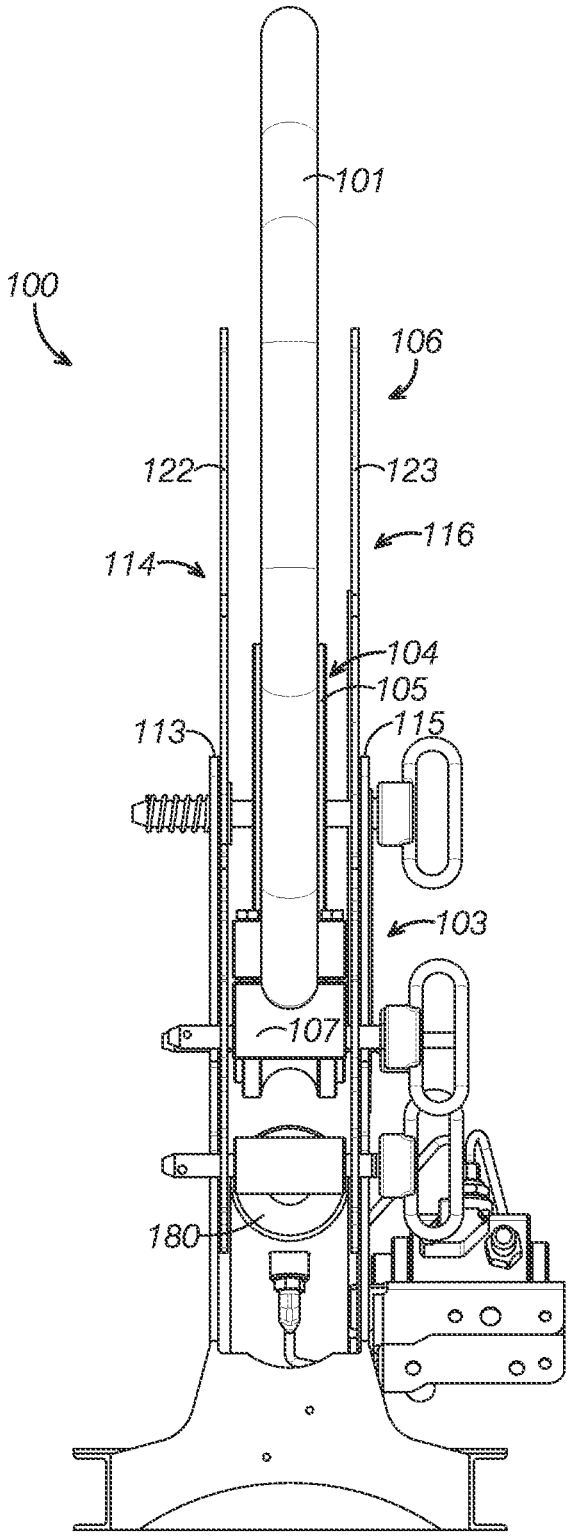
FIG. 6 is a front end view of the tube bending machine shown in FIG. 1.
Figure 7:
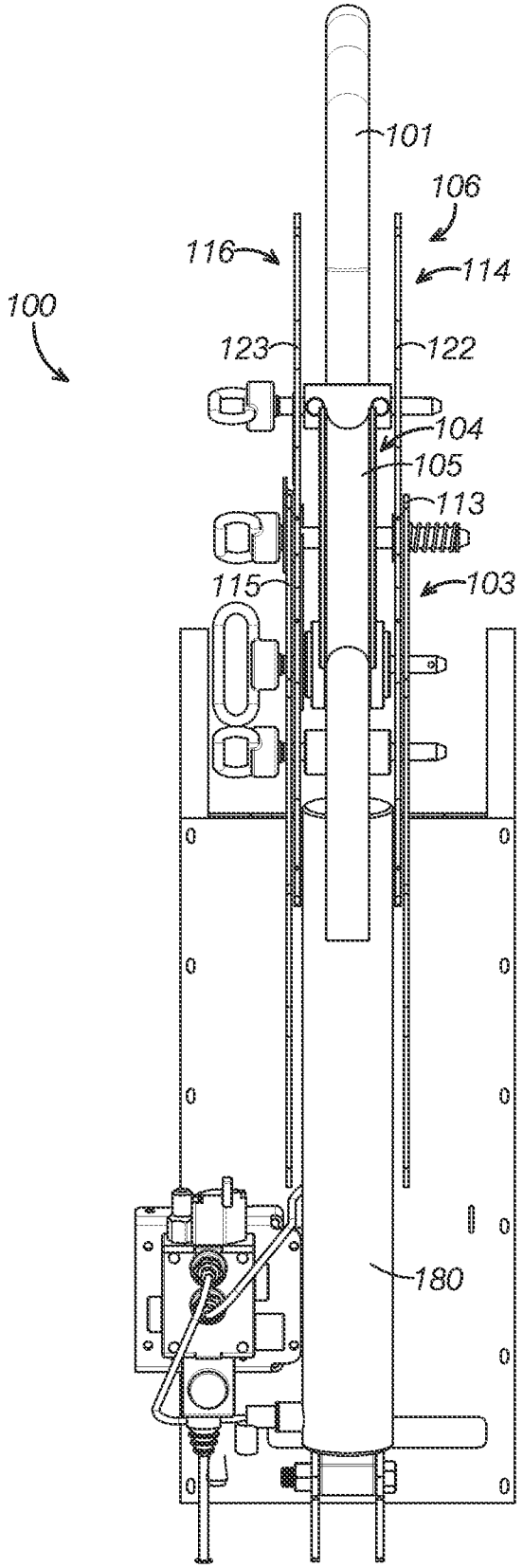
FIG. 7 is a top view of the tube bending machine shown in FIG. 1.

Tube 101 is bent to defined parameters by the tube bending machines described below. As shown in FIG. 3, tube 101 includes a target bend location 102, which is marked on tube 101 with a vertical line prior to inserting tube 101 into tube bending machine 100.

The tube may be any currently known or later developed type of tube, pipe, or solid bar. The reader will appreciate that a variety of tube types exist and could be used in place of the tube shown in the figures. In addition to the types of tubes existing currently, it is contemplated that the tube bending machines described herein could be used with new types of tubes developed in the future.

The size and shape of the tube may be varied as needed for a given application some examples, the tube is larger relative to the other components than depicted in the figures. In other examples, the tube is smaller relative to the other components than depicted in the figures. Further, the reader should understand that the tube and the other components may all be larger or smaller than described herein while maintaining their relative proportions. The tube may be round, square, rectangular, an aerodynamic shape, an ovoid shape, a solid bar, and many other shapes and configurations.

The tube may be any of a wide variety of currently known or later developed metals and effectively bent and notched by the tube bending machines described below. Suitable tube materials include carbon steels (1010, 1020, 1026, and 4130 steel), stainless steels, aluminum (6061 and 6063 up to T6 temper), titanium in CWSR (cold worked stress relieved) and annealed condition (2.5AL-3V CP2, others), as well as copper and its alloys.

Tube Bending Machine Embodiment One

With reference to FIGS. 1-8, a tube bending machine 100 will now be described as a first example of a tube bending machine. The reader can see in FIGS. 1-7 that tube bending machine 100 functions to bend a tube 101 at a target bend location 102.

As depicted in FIGS. 1-7, tube bending machine 100 includes a frame 103, a bending die assembly 104, and an alignment system 109. In other examples, the tube bending machine includes fewer components than depicted in the figures. In certain examples, the tube bending machine includes additional or alternative components than depicted in the figures.

The size and shape of the tube bending machine may be varied as needed for a given application. In some examples, the tube bending machine is larger relative to the other components than depicted in the figures. In other examples, the tube bending machine is smaller relative to the other components than depicted in the figures. Further, the reader should understand that the tube bending machine and the other components may all be larger or smaller that described herein while maintaining their relative proportions.

Frame

Frame 103 functions to support components of tube bending machine 101, including bending die assembly 104, and an alignment system 109. As shown in FIGS. 1, 2 and 4-7 frame 103 is an enclosed type of Frame. In other examples, the frame is an open type of frame.

The reader can see in FIGS. 1-7 that frame 103 includes a first frame member 113 and a second frame member 115, With reference to FIGS. 1-7, first frame member 113 is on a first lateral side 114 of bending die assembly 104. As depicted in FIGS. 1-7, second frame member 115 is on a second lateral side 116 of bending the assembly 104 opposite first lateral side 114.

In the present example, the frame and frame members are composed of metal. However, the frame may be composed of any currently known or later developed material suitable for the applications described herein for which it s used. Suitable materials include metals, polymers, ceramics, wood, and composite materials.

The Frame may be any currently known or later developed type of frame. The reader will appreciate that a variety of frame types exist and could be used in place of the frame shown in the figures. In addition to the types of frames existing currently, it is contemplated that the tube bending machines described herein could incorporate new types of frames developed in the future.

The size and shape of the frame may be varied as needed for a given application. In some examples, the frame is larger relative to the other components than depicted in the figures. In other examples, the frame is smaller relative to the other components than depicted in the figures. Further, the reader should understand that the frame and the other components may all be larger or smaller than described herein while maintaining their relative proportions Bending Die Assembly Bending die assembly 104 is configured to bend tube 101. As can be seen in F bending die assembly 104 is supported on frame 103.

In the present example, bending die assembly 104 includes a bending die 105, a wheel frame 106, a clamp 107, and an actuator 180. In other examples, the bending die assembly includes fewer components than bending die assembly 104. In certain examples, the bending die assembly includes additional or alternative components than bending die assembly 104.

The components of bending die 104 will now be described in more detail.

Bending Die

The role of bending die 105 is to provide a rigid surface against which tube 101 may be bent. With reference to FIG. 1, bending die 105 is circular. In particular, as shown in FIG. 1, bending die 105 is a complete circle. However, the bending die may be a partial circle in other examples.

The bending die may be any currently known or later developed type of bending die. The reader will appreciate that a variety of bending die types exist and could be used in place of the bending die shown in the figures. In addition to the types of bending dies existing currently, it is contemplated that the tube bending machines described herein could incorporate new types of bending dies developed in the future.

The size and shape of the bending die may be varied as needed for a given application. In some examples, the bending die is larger relative to the other components than depicted in the figures. In other examples, the bending die is smaller relative to the other components than depicted in the figures. Further, the reader should understand that the bending die and the other components may all be larger or smaller than described herein while maintaining their relative proportions.

In the present example, the bending die is composed of metal. However, the bending die nm composed of any currently known or ater developed material suitable for the applications described herein for which it is used. Suitable materials include metals, polymers, ceramics, wood, and composite materials.

Wheel Frame

Wheel frame 106 is configured to rotate when driven by actuator 180 and press tube 101 against bending die 105 via clamp 107. Wheel frame 106 pressing tube 101 against bending die 105 functions to bend tube 101 around bending die 105. Wheel frame 106 is selectively rotated by actuator 180.

The reader can see in FIGS. 1, 2, and 4-7 that wheel frame 106 includes a first wheel frame member 122 and a second wheel frame member 123. As shown in FIGS. 1, 2, and 4-7, wheel frame 106 is coaxially mounted to bending die 105, The reader can see in FIGS. 1, 2, and 4-7 that first wheel frame member 122 is on first lateral side 114 of bending die 105. With reference to FIGS. 1, 2, and 4-7, second wheel frame member 123 is on second lateral side 116 of bending die 105 opposite first lateral side 114.

As depicted in FIGS. 1-3 and 5, first wheel frame member 122 defines an opening 124. The reader can see in FIGS. 1-3 and 5 that opening 124 is aligned with slot 110. Opening 124 being aligned with slot 110 makes tube 101 visible through slot 110 from a position outside bending die assembly 104 when tube 101 is disposed in bending die assemble 104. Tube 101 being visible through slot 110 enables an operator to properly align rube 101 relative to actual bend location 108 of tube bending machine 100.

The size and shape of the wheel frame members may be varied as needed for a given application. In some examples, the wheel frame members are larger relative to the other components than depicted in the figures. In other examples, the wheel frame members are smaller relative to the other components than depicted in the figures. Further, the reader should understand that the wheel frame members and the other components may all be larger or smaller than described herein while maintaining their relative proportions.

In the present example, the wheel frame members are composed of metal. However, the wheel frame members may be composed of any currently known or later developed material suitable for the applications described herein for which they are used. Suitable materials include metals, polymers, ceramics, wood, and composite materials.

Clamp

With reference to FIGS. 1-3 and 5-7, clamp 107 is configured to secure tube 101 to wheel frame 106. Expressed another way, clamp 107 functions to mechanically couple wheel frame 106 to tube 101.

As described above, actuator 180 of tube bending machine selectively rotates wheel frame 106. Wheel frame 106 rotating presses tube 101 against bending die 105 via clamp 107 to bend tube 101 around bending die 105.

The clamp may be any currently known or later developed type of clamp. The reader will appreciate that a variety of clamp types exist and could be used in place of the clamp shown in the figures. In addition to the types of clamps existing currently, it is contemplated that the tube bending machines described herein could incorporate new types of clamps developed in the fixture.

The size and shape of the clamp may be varied as needed for a given application some examples, the clamp is larger relative to the other components than depicted in the figures. In other examples, the clamp is smaller relative to the other components than depicted in the figures. Further, the reader should understand that the clamp and the other components may all be larger or smaller than described herein while maintaining their relative proportions.

Actuator

Actuator 180 functions to selectively rotate wheel frame 106 to press tube 101 against bending die 105 via clamp 107. The actuator may be any currently known or later developed type of actuator. The reader will appreciate that a variety of actuator types exist and could be used in place of the actuator shown in the figures. In addition to the types of actuators existing currently, it is contemplated that the tube bending machines described herein could incorporate new types of actuators developed in the future.

The size and shape of the actuator may be varied as needed for a given application. In some examples, the actuator is larger relative to the other components than depicted in the figures. In other examples, the actuator is smaller relative to the other components than depicted in the figures. Further, the reader should understand that the actuator and the other components may all be larger or smaller than described herein while maintaining their relative proportions.

Actual Bend Location

Actual bend location 108 is where tube 101 will be bent by bending die assembly 104. The reader can see in FIGS. 1-7 that bending die 105, wheel frame 106, clamp 107, and actuator 180 cooperate to define actual bend location 108. As depicted in FIG. 3, actual bend location 108 corresponds to a substantially vertical plane perpendicular to a longitudinal axis of tube 101.

Alignment System.

Alignment system 109 functions to align target bend location 102 with actual bend location 108. In the present example, as shown in FIGS. 1-7, alignment system 109 is configured to align target bend location 102 with actual bend location 108 when bending die assembly 104 is set to a zero-degree bend configuration. However, the alignment system nay be configured to align the target bend location with the actual bend location when the bending die assembly is set bend degree configurations other than zero, such as a. 15-degree, 30-degree, or 45-degree bend configurations.

Figure 2:
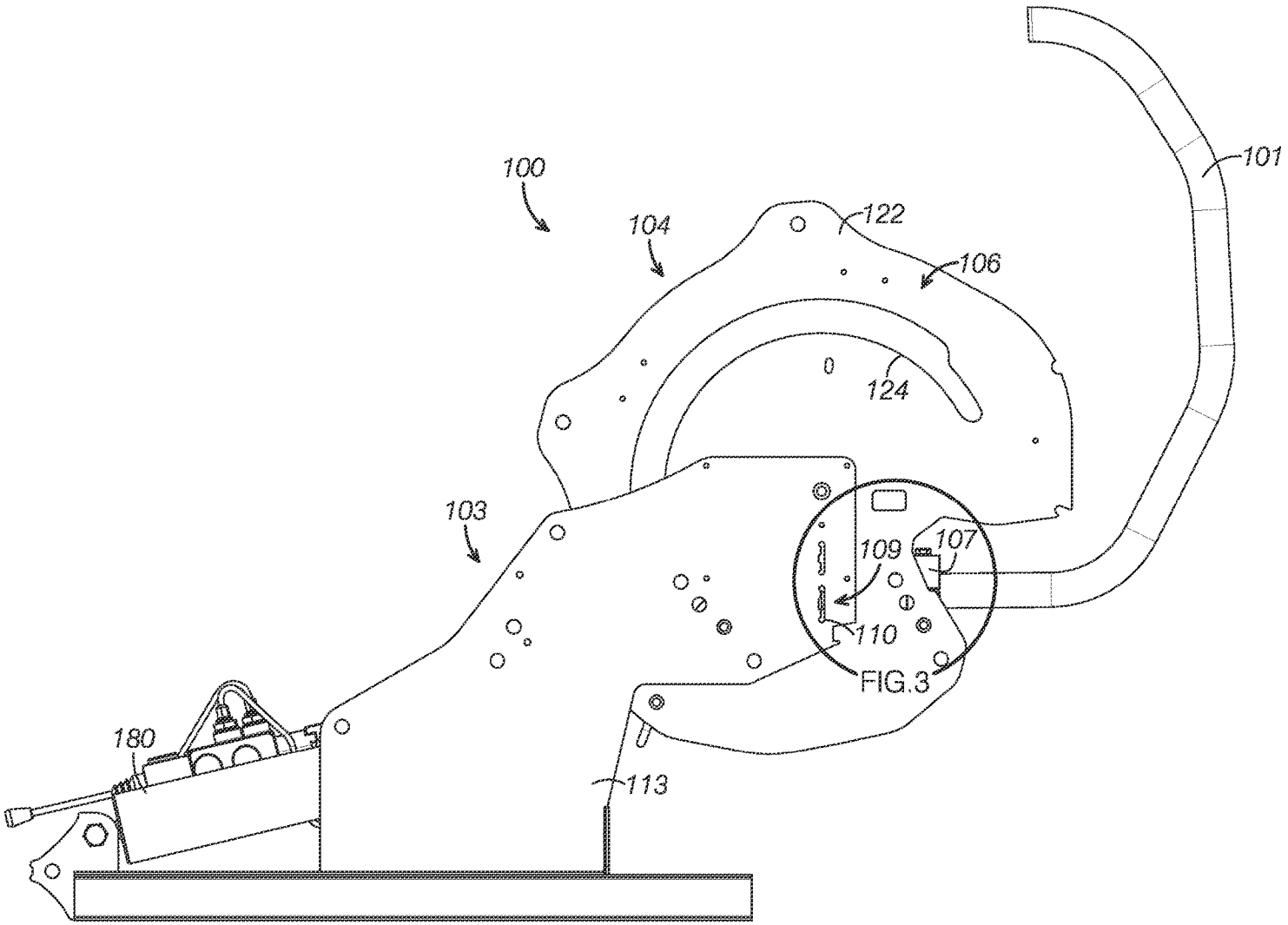
FIG. 2 is a right side elevation view of the tube bending machine shown in FIG. 1.

As shown in FIGS. 2 and 3, alignment system 109 is operatively supported on frame 103, in the present example of the alignment system, the reader can see in FIGS. 2 and 3 that alignment system 109 includes a slot 110 defined in frame 103. Slot 110 is described in more detail below.

The size and shape of the alignment system may be varied as needed for a given application. In some examples, the alignment system is larger relative to the other components than depicted in the figures. In other examples, the alignment system is smaller relative to the other components than depicted in the figures. Further, the reader should understand that the alignment system and the other components may all be larger or smaller than described herein while maintaining their relative proportions.

Figure 8:
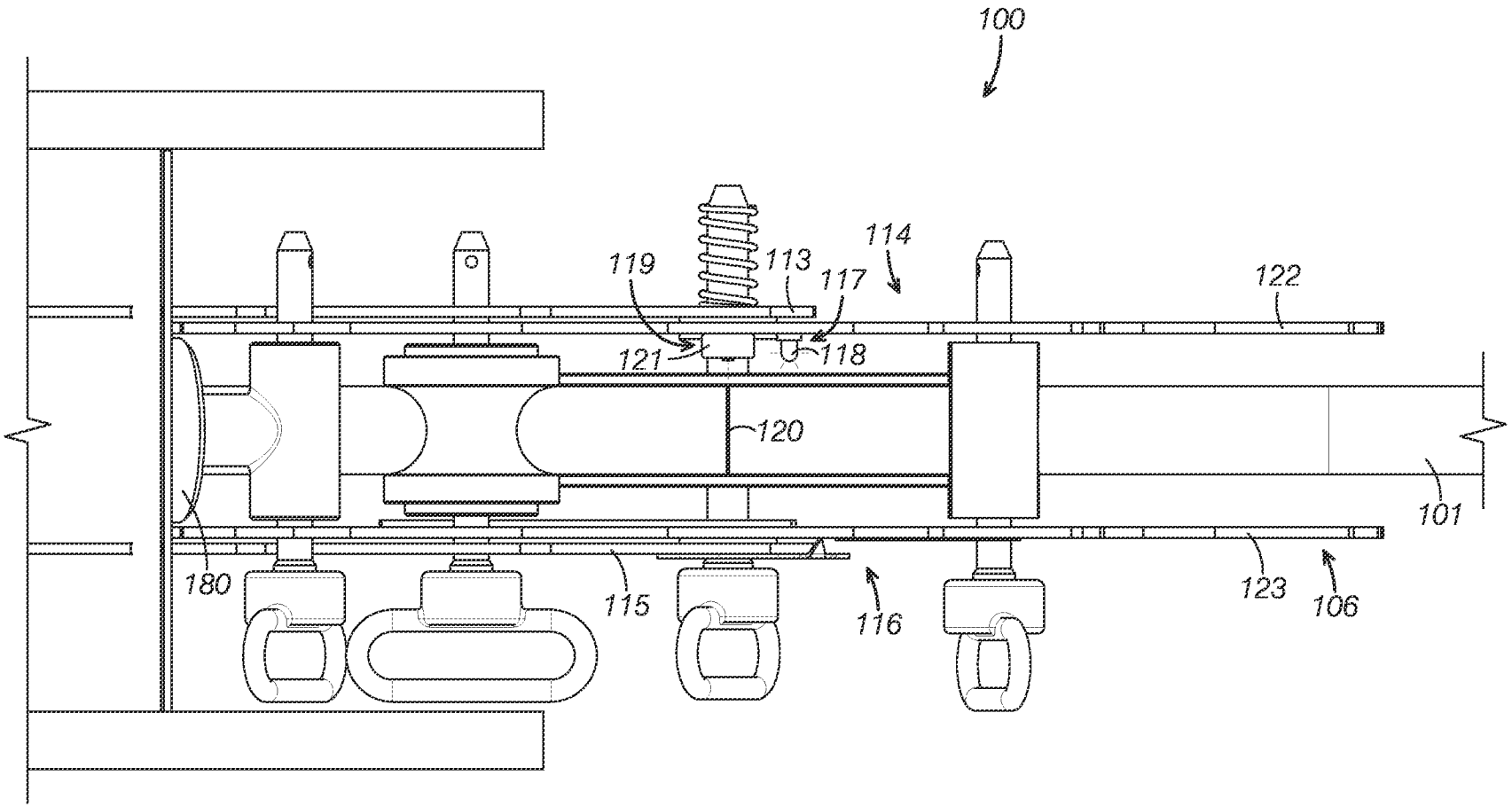
FIG. 8 is a close up bottom view of the tube bending machine shown in FIG. 1 with an optional illumination device and an optional laser light projector.

Optionally, as depicted in FIG. 8, alignment system 109 may include an illumination device 117. Illumination device 117 is configured to illuminate tube 101 in bending die assembly 104 proximate actual bend location 108.

As depicted in FIG. 8, illumination device 117 includes a light emitting diode 118. However, the illumination device may be any currently known or Eater developed type of illumination device. The reader will appreciate that a variety of illumination device types exist and could be used in place of the illumination device shown in the figures. In addition to the types of illumination devices existing currently, it is contemplated that the tube bending machines described herein could incorporate new types of illumination devices developed in the future.

The number of illumination devices in the tube bending machine may be selected to meet the needs of a given application. The reader should appreciate that the number of illumination devices may be different in other examples than is shown in the figures. For instance, some tube bending machine examples include additional or fewer illumination devices than described in the present example.

The size and shape of the illumination device may be varied as needed for a given application. In some, examples, the illumination device is larger relative to the other components than depicted in the figures. In other examples, the illumination deice is smaller relative to the other components than depicted in the figures. Further, the reader should understand that the illumination device and the other components may all be larger or smaller than described herein while maintaining their relative proportions.

With reference to FIG. 8, alignment system 109 may also optionally include a light projector 119. Light projector 119 is configured to project an indicator 120 on tube 101 in bending die assembly 104. With reference to FIG. 8, indicator 120 corresponds to actual bend location 108. As shown in FIG. 8, indicator 120 is a vertical line, but may be any other orientation, shape, or design suitable for indicating where bending e assembly 104 will bend tube 101. In some examples, the indicator is an X-shaped design, a circular dot, or a bullseye design.

As shown in FIG. 8, light projector 119 includes a laser light projector 121. However, the light projector may be any currently known or later developed type of light projector. The reader will appreciate that a variety of Eight projector types exist and could be used in place of the light projector shown in the figures. In addition to the types of light projectors existing currently, it is contemplated that the tube bending machines described herein could incorporate new types of light projectors developed in the future.

Slot

Slot 110 functions to make tube 101 visible near actual bend location 108 when tube 101 is mounted in tube bending machine 100. With reference to FIG. 3, tube 101 is visible through slot 110 from a position outside bending die assembly 104 when tube 101 is disposed in bending die assembly 104. As depicted in FIGS. 2 and 3, slot 110 is aligned with actual bend location 108.

As shown in FIG. 3, slot 110 defines a vertical edge 111 aligned with actual bend location 108. Vertical edge 111 enables a user to conveniently align a vertical mark on tube 101 corresponding to target bend location 102 wish vertical edge 111, which correlates to actual bend location 108.

The reader can see in FIG. 3 that slot 110 defines a lobe 112 proximate vertical edge 111. Lobe 112 allows more light to shine on actual bend location 108 within bending die assembly 104. Increased light shining on actual bend location 108 hems to align target bend location 102 with actual bend location 108.

As depicted in FIG. 3, slot 110 has a vertical height exceeding the diameter of tube 101. However, the size and shape of the slot may be varied as needed for a given application. In some examples, slot is larger relative to the other components than depicted in the figures. In other examples, the slot is smaller relative to the other components than depicted in the figures. Further, the reader should understand that the slot and the other components may all be larger or smaller than described herein while maintaining their relative proportions.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the closed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A tube bending machine for bending a tube at a target bend location, the tube bending machine comprising:

a frame;

a bending die assembly supported on the frame and configured to bend the tube, the bending die assembly including:

a bending die;

a wheel frame coaxially mounted to the bending die; and a clamp configured to secure the tube to the wheel frame;

wherein the bending die, the wheel frame, and the clamp cooperate to define an actual bend location where the tube will be bent by the bending die assembly; and an alignment system operatively supported on the frame and configured to align the target bend location with the actual bend location;

wherein:

the alignment system includes a slot defined in the frame;

the slot is aligned with the actual bend location;

the tube is visible through the slot from a position outside the bending die assembly when the tube is disposed in the bending die assembly;

the actual bend location corresponds to a substantially vertical plane perpendicular to a longitudinal axis of the tube; and the slot defines a vertical edge aligned with the actual bend location.

2. The tube bending machine of claim 1, wherein the slot defines a lobe proximate the vertical edge to allow more light to shine on the actual bend location within the bending die assembly.

3. The tube bending machine of claim 1, wherein the slot has a vertical height exceeding the diameter of the tube.

4. The tube bending machine of claim 1, wherein the frame is enclosed.

5. The tube bending machine of claim 4, wherein the frame includes:

a first frame member on a first lateral side of the bending die assembly; and a second frame member on a second lateral side of the bending die assembly opposite the first lateral side.

6. The tube bending machine of claim 1, wherein the bending die is circular.

7. The tube bending machine of claim 6, wherein the bending die is a complete circle.

8. The tube bending machine of claim 1, wherein:

the tube bending machine includes the tube; and the target bend location is marked on the tube.

9. The tube bending machine of claim 1, wherein the alignment system includes an illumination device configured to illuminate the tube in the bending die assembly proximate the actual bend location.

10. The tube bending machine of claim 9, wherein the illumination device includes a light emitting diode.

11. The tube bending machine of claim 1, wherein:

the alignment system includes a light projector configured to project an indicator on the tube in the bending die assembly; and the indicator corresponds to the actual bend location.

12. The tube bending machine of claim 11, wherein the indicator is a vertical line.

13. The tube bending machine of claim 11, wherein the light projector includes a laser light projector.

14. The tube bending machine of claim 1, wherein the alignment system is configured to align the target bend location with the actual bend location when the bending die assembly is set to a zero-degree bend configuration.

15. A tube bending machine for bending a tube at a target bend location, the tube bending machine comprising:

a frame;

a bending die assembly supported on the frame and configured to bend the tube, the bending die assembly including:

a bending die;

a wheel frame coaxially mounted to the bending die; and a clamp configured to secure the tube to the wheel frame;

wherein the bending die, the wheel frame, and the clamp cooperate to define an actual bend location where the tube will be bent by the bending die assembly; and an alignment system operatively supported on the frame and configured to align the target bend location with the actual bend location;

wherein:

the wheel frame includes:

a first wheel frame member on a first lateral side of the bending die; and a second wheel frame member on a second lateral side of the bending die opposite the first lateral side;

the alignment system includes a slot defined in the frame;

the slot is aligned with the actual bend location; and the first wheel frame member defines an opening aligned with the slot to enable the tube to be visible through the slot from a position outside the bending die assembly when the tube is disposed in the bending die assembly.

* * * * *